United States Patent [19]

Zifferer

[11] Patent Number: 4,768,495

[45] Date of Patent: Sep. 6, 1988

[54] HEATING APPARATUS AND METHOD

[75] Inventor: Lothar R. Zifferer, Waco, Tex.

[73] Assignee: Packless Metal Hose, Inc., Waco, Tex.

[21] Appl. No.: 888,077

[22] Filed: Jul. 22, 1986

[51] Int. Cl.[4] ..... F24D 9/00; F24H 1/20

[52] U.S. Cl. ..... 126/101; 126/360 A; 122/5.5 A; 237/19; 110/215

[58] Field of Search ..... 126/101, 360 R, 360 A; 122/5.5 A, 14, 31 A, 182 R; 110/215; 237/16, 17, 19

[56] References Cited

U.S. PATENT DOCUMENTS

| | | | |
|---|---|---|---|
| 2,333,497 | 11/1943 | Velander | 60/39.57 X |
| 2,827,893 | 3/1958 | Ribaudo et al. | 126/101 |
| 4,178,907 | 12/1979 | Sweat, Jr. | 126/101 |
| 4,685,444 | 8/1987 | Dürrenberger | 126/360 A |

*Primary Examiner*—Samuel Scott
*Assistant Examiner*—Allen J. Flanigan
*Attorney, Agent, or Firm*—Neal J. Mosely

[57] ABSTRACT

An apparatus for heating a liquid by circulating combustion products comprises a housing having a liquid-containing reservoir compartment and a burner compartment thereabove containing a fuel burner for burning a mixture of air and combustible gases, liquids or particulate solids. An electric motor mounted above the burner has a shaft extending downward into the liquid in the reservoir with an impeller on the lower end submerged in the liquid. Rotation of the impeller produces suction in the liquid drawing hot combustion gases into the liquid and disperses the same as hot gas bubbles which heat the liquid efficiently. A portion of the liquid is conducted from the reservoir and discharged close to the burner to cool the burning mixture. The heated liquid may be reycled through a hot water supply piping system for industrial usage. A coil submerged in the reservoir allows a second liquid to be heated thereby for use in a hot water supply system for residential or industrial usage.

46 Claims, 4 Drawing Sheets

HEATING APPARATUS AND METHOD

BACKGROUND OF THE INVENTION

1. Field of the Invention

This invention relates generally to heating apparatus, and more particularly to a method and apparatus utilizing submerged products of combustion for heating liquids.

2. Brief Description of the Prior Art

Heinze, U.S. Pat. No. 2,890,166 discloses a process and apparatus utilizing submerged combustion in which a first body of liquid is in direct contact with a submerged flame. A second body of liquid communicates with the first by a passageway positioned above the flame whereby the first body of liquid can overflow into the second body of liquid. Incondensible gases are removed from a space above the second body of liquid. A third body of liquid communicates with the second and condensible vapors are removed from a space above said third body of liquid, and a portion of the resultant liquid from the third body of liquid is returned to the first body of liquid at a point below the submerged flame.

Wyatt, U.S. Pat. Nos. 4,418,651 and 4,441,460 discloses methods and apparatus for heating and utilizing fluids by the use of vapor generators. A flowing fuel/air mixture is burned in the presence of a stream of feed water to produce a stream of steam and non-condensibles at low pressure which is then heat exchanged with a stream of the fluid to be heated and utilized. The heated fluid may be divided into two or more streams during the heat exchange, with different amounts of heat delivered into each stream. The heat exchange is so conducted as to condense the steam from the stream of steam and non-condensibles, and the condensate so formed is selectively recycled to the vapor generator as feed water.

DeBord, U.S. Pat. No. 3,756,171 discloses an air pollution control system used in the burning of rubbish wherein the noncombustibles from the incinerator are caught and cooled by being forced into a water bath where it is scrubbed with water, filtered, and deposited in a final bath tank to then be purified and deposited into the municiple drain system.

Mercer, U.S. Pat. No. 3,572,264 discloses another system for removing visible smoke and suspended particles by washing and filtering the products of burning including a method of recirculating the burned gases from the cleaning process into the combustion chamber.

Iwanaga et al, U.S. Pat. No. 3,224,170 discloses a gas purification apparatus wherein the gas to be purified is passed through a tube submerged in a tank of purification liquid along with a portion of the purification liquid. The semi-purified gases exit the end of the tube and carry some of the liquid with it into a funnel tube. Consequently, the gas and liquid rise in a coexistent state to a level higher than the liquid level in the tank. Finally, the gas separates from the liquid and flows out from the funnel tube in a purified state.

The present invention is distinguished over the prior art in general, and these patents in particular by apparatus for heating a liquid by circulating combustion products. The apparatus comprises a housing having a liquid-containing reservoir compartment and a burner compartment thereabove with a fuel burner therein for burning a mixture of air and combustible gases, liquids or particulate solids. An electric motor mounted above the burner has a shaft extending downward into the liquid in the reservoir with an impeller mounted on the lower end submerged in the liquid. Rotation of the impeller produces suction in the liquid dwawing in hot combustion gases and dispersing the same as hot gas bubbles which heat the liquid more efficiently. A portion of the liquid is conducted from the reservoir and discharged close to the burner to cool the burning mixture. A coil submerged in the reservoir allows a second liquid to be heated by the liquid in the reservoir. Both liquids may recycled for various residential or industrial uses.

SUMMARY OF THE INVENTION

It is therefore a primary object of the present invention to provide a method and apparatus utilizing submerged products of combustion to heat liquids for providing hot water for domestic or industrial use.

It is another object of this invention to provide a method and apparatus utilizing submerged products of combustion by dispersing the same into a liquid reservoir as small bubbles heating the water more efficiently for domestic or industrial heating or other uses.

It is another object of this invention to provide a method and apparatus utilizing submerged products of combustion in combination with a fan coil unit to supply warm air for house heating and hot water for domestic use.

Another object of this invention is to provide a method and apparatus utilizing submerged products of combustion in combination with a baseboard-radiator coil unit to supply warm air for house heating and hot water for domestic use.

Another object of this invention is to provide a method and apparatus utilizing submerged products of combustion to supply warm water to the evaporator of heat pumps.

Another object of this invention is to provide a method and apparatus utilizing submerged products of combustion to supply hot water for use in industrial applications in heating various fluids and chemicals.

Other objects of the invention will become apparent from time to time throughout the specification and claims as hereinafter related.

The above noted objects and other objects of the invention are accomplished by an apparatus for heating a liquid by circulating combustion products from a fuel burner. The apparatus comprises a housing having a liquid-containing reservoir compartment and a burner compartment thereabove containing a fuel burner for burning a mixture of air and combustible gases, liquids or particulate solids. An electric motor mounted above the burner has a shaft extending downward into the liquid in the reservoir with an impeller on the lower end submerged in the liquid. Rotation of the impeller produces suction in the liquid drawing hot combustion gases into the liquid and disperses the same as hot gas bubbles which heat the liquid efficiently. A portion of the liquid is conducted from the reservoir and discharged close to the burner to cool the burning mixture. The heated liquid may be recycled through a hot water supply piping system for industrial usage. A coil submerged in the reservoir allows a second liquid to be heated thereby for use in a hot water supply system for residential or industrial usage.

DESCRIPTION OF THE PREFERRED EMBODIMENT

Figure 3:
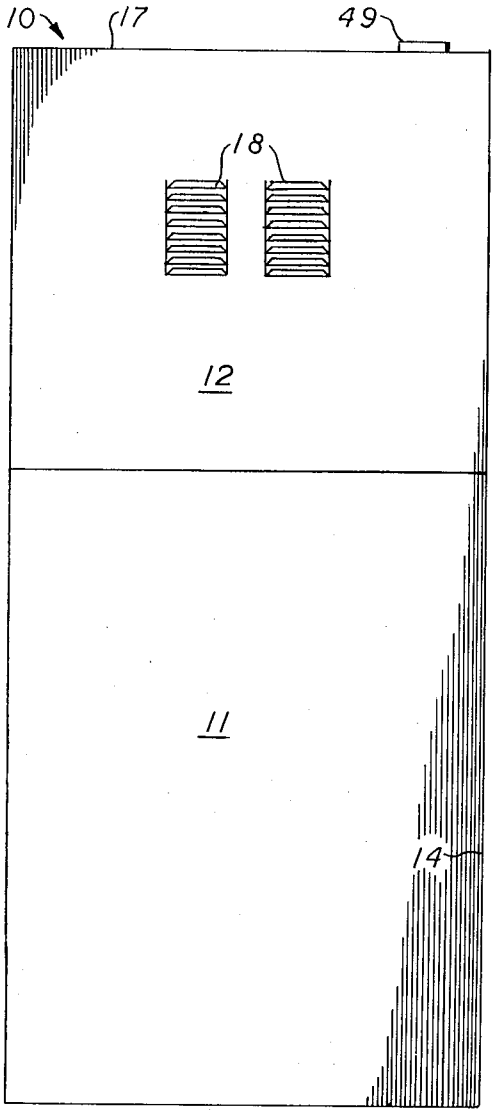
FIG. 3 is a rear elevation view of the heater apparatus of FIG. 1.

Referring to the drawings by numerals of reference, there is shown in FIGS. 1 through 4, a preferred heater apparatus 10 utilizing submerged combustion products. The heater 10 comprises an insulated cylindrical lower compartment or reservoir 11 and a cylindrical upper burner compartment 12 which may or may not be insulated. The reservoir compartment 11 has a bottom wall 13, side wall 14, and an insulated removable top wall 15 of double wall insulated sandwich construction. The burner compartment 12 has a side wall 16, and a top wall 17. Air intake louvers 18 are formed in the side wall 16. It should be understood that the heater may also be constructed in a rectangular or square shape.

The top wall 15 of reservoir compartment 12 has a central opening 18. Nipples or other suitable connections through the side wall 14 provide an inlet 19 and outlet 20 for connecting the reservoir compartment 11 into various heating systems. Reservoir compartment 11 is substantially filled with a suitable liquid 21, such as water, which may be used to supply hot water in various applications, described hereinafter, but is not particularly suited for domestic use, such as for drinking, shower or washing purposes. Drain tube 22, connected at its lower end to a condensate drain, extends upwardly inside reservoir compartment 11 to a point above the surface of the reservoir liquid to control water level and prevent accumulation of water and combustion products condensing in the reservoir. Temperature control switch 23 is located beneath the surface of the liquid 21 in the reservoir 11.

A combustion chamber 24 resides above the reservoir top wall 15 above the opening 18. Combustion chamber 24 comprises an insulated cylindrical side wall 25 enclosed at each end by top wall 26 and bottom wall 27 having central openings 28 and 29, respectively. A cylindrical double wall member is secured concentrically inward of the side wall 25 and enclosed by the top and bottom walls 26 and 27 to form a cylindrical water jacket 30. Temperature control switch 31 is installed in top wall 27 with the sensor element extending into water jacket 30. The top portion of the interior wall of water jacket 30 has a plurality of circumferentially spaced apertures 32. An electrical control box 33 containing electrical circuitry and the ignition control unit for the system (described hereinafter) is mounted within burner compartment 12.

Electric motor 34 is mounted above top wall 26 of combustion chamber 24 with an elongated rotatable shaft 35 extending downwardly through the opening 29 into the reservoir liquid 21. An apertured burner 36 mounted on the top wall 26 extends downwardly beneath the opening 28 into the combustion chamber 24 surrounding the top portion of the shaft 35.

A plurality of radially extending inductor blades or vanes 37 are mounted on the shaft 35 at the top of the burner 36 to induct a mixture of air and gas into the burner. Water pump 38 is operatively mounted on the lower end of the shaft 35 with a squirrel cage type impeller 39 mounted on the shaft just above the pump. An ignitor 40 extends downwardly from the top wall 26 adjacent burner 36. Gas/air valve 41 is housed within the burner compartment 12 adjacent louvers 18 and is operatively connected to the top of the burner 36.

Tube 42 extends upwardly from water pump 38 into the bottom of the water jacket 30 and pressure control switch 43 is installed in tube 42 between pump 38 and water jacket 30. Water is pumped from the reservoir into water jacket 30 through tube 42 and is discharged through apertures 32 causing it to spray into the combustion chamber 24 to cool the combustion gases. Conductor tube 45 extends downwardly from the bottom wall 27 of combustion chamber 24 and terminates just above the squirrel cage impeller 39 and surrounds shaft 35. Conductor tube 45 conducts products of combustion and return water into the reservoir liquid.

A tubular hot water coil 46 submerged in the reservoir liquid 21 surrounds conductor tube 45, pump 38, and impeller 39. Nipples 47 and 48 or other suitable connections are provided through side wall 14 to connect coil 46 into the domestic water supply line of the building being served by the heater to provide hot water for domestic use. As cold water from the city supply line flows through coil 46, it becomes heated due to the surrounding hot reservoir liquid (as explained hereinafter). In some applications, the hot water coil may be eliminated.

Vent tube 49 extends through top wall 15 of reservoir compartment 11 and outwardly of burner compartment 12 allowing hot air and gases to escape from the reservoir.

The following is a brief description of the principle of operation of the heater, and its use of submerged combustion products which will be explained in greater detail hereinafter.

Motor shaft 35 rotates the squirrel cage impeller 39 submerged in the reservoir liquid 21 causing suction to be developed drawing a mixture of air and gas from the valve 41 through the burner 36. The gases are premixed prior to combustion by the rotating vanes 37 attached to the upper portion of the shaft 35 of the motor 34.

Combustion occurs as the gases emerge from the apertured surface of the burner 36. The combustion gases are cooled by the reservoir liquid 21 pumped through tube 42 into water jacket 30 and sprayed through appertures 32 into combustion chamber 24 by means of pump 38 mounted on the same shaft 35 as impeller 39. The cooling liquid and the combustion gases are drawn in to the reservoir liquid 21 through conductor tube 45. The gases which are still hot, are dispersed in the form of small bubbles B which effectively transfer or give up heat into the reservoir liquid, thus heating the liquid in the reservoir.

Hot water coil 46 submerged in reservoir liquid 21 provides hot water for domestic use. As cold water from the city line flows through the hot water coil 21, it becomes heated due to the surrounding hot reservoir liquid. Liquid level control tube 22 in reservoir compartment 11 controls the reservoir liquid level and prevents accumulation of liquid and products of combustion which condense in the reservoir.

CONTROL SYSTEM

Figure 5:
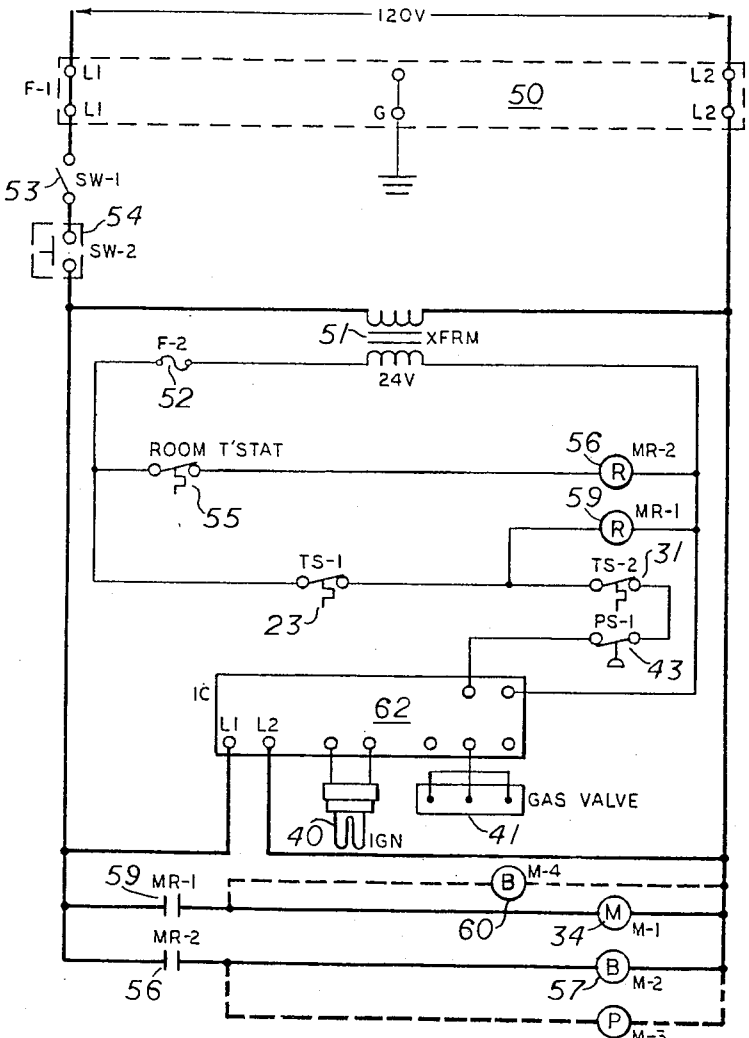
FIG. 5 is an electrical schematic of the control system for the heater apparatus.

Referring now to FIG. 5, an electrical diagram for the control system for the submerged combustion heater is shown. The diagram represents a typical application wherein the heater provides hot water for house heating through a fan coil unit and hot water for domestic use. This application is described in detail hereinafter and uses more components than are required in some other applications, and it should be understood that components represented by dotted line may be eliminated in less complex applications.

120 V. AC power is supplied to the system through a grounded power block 50. A 120/24 volt transformer 51 supplies reduced voltage to the system components and the system is protected by a 3 amp. fuse 52. On-off switch 53 connects the control system with the power source, and a safety switch in the form of door switch 54 controls a forced air furnace in accordance with the AGA standard for gas furnaces. This safety feature prevents the operation of the main gas valve and the furnace blower if an access door or a panel covering an opening to a circulating air compartment is not in place.

Room thermostat 55 controls the room temperature in the house and is connected through relay 56 with furnace coil blower 57 and circulator pump 58. Thermostat 55 sends a signal to turn on circulator pump 58 and blower motor 57 when the room thermostat calls for heat. Temperature control switch 23 in the reservoir liquid 21 will open upon a temperature rise to control the temperature of the reservoir liquid.

Temperature control switch 23 in the reservoir liquid is connected through relay 59 to motor 34 inside heater 10 and to exhaust blower motor 60 in fan coil unit 61. Switch 23 will activate the burner 36 when the liquid in the reservoir drops below a set value and turns the burner off when the reservoir liquid temperature exceeds a set high limit. When switch 23 calls for heat to the reservoir, relay 59 turns on motor 34 and blower motor 57. Motor 34 (suction motor) will run until the temperature limit set by temperature control switch 23 is reached.

When motor 34 is turned on, the water flow to water jacket 30 is sensed by the pressure switch 43 in tube 42 between pump 38 and water jacket 30. Pressure switch 43 sends a signal to an ignition control unit 33 to turn on the burner. The ignition control unit 33 controls the operation of gas valve 41 and igniter 40 to ignite the gas/air mixture. Since pump 38 to burner water jacket 30 is mounted on the same shaft 35 as suction impeller 39, detection of liquid flow to combustion chamber 24 would translate into the establishment of suction.

The other temperature control switch 31 installed in water jacket 30 is a safety feature which will turn the burner off if the temperature of the liquid used to cool the combustion gases reaches a set high limit. This safety feature complies with the AGA standard which requires two temperature limit controls to be present.

SEQUENCE OF OPERATION

Figure 1:
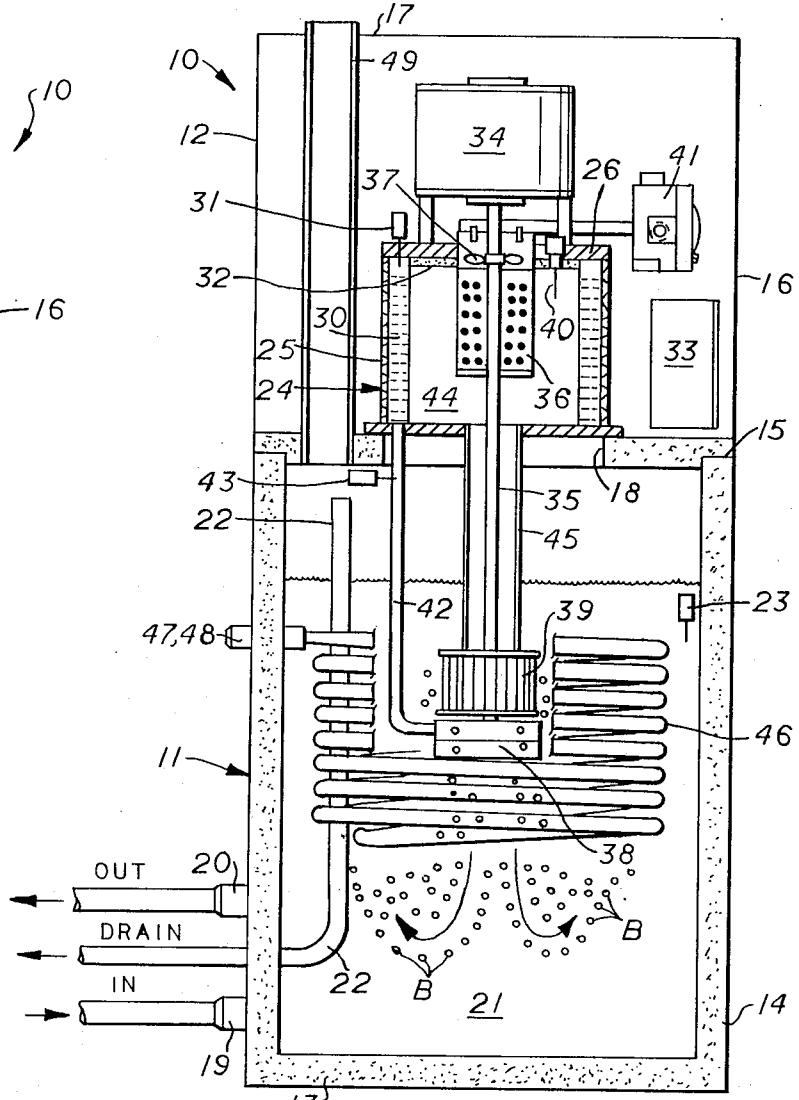
FIG. 1 is a front elevation view in cross section of the heater apparatus in accordance with the present invention.
Figure 2:
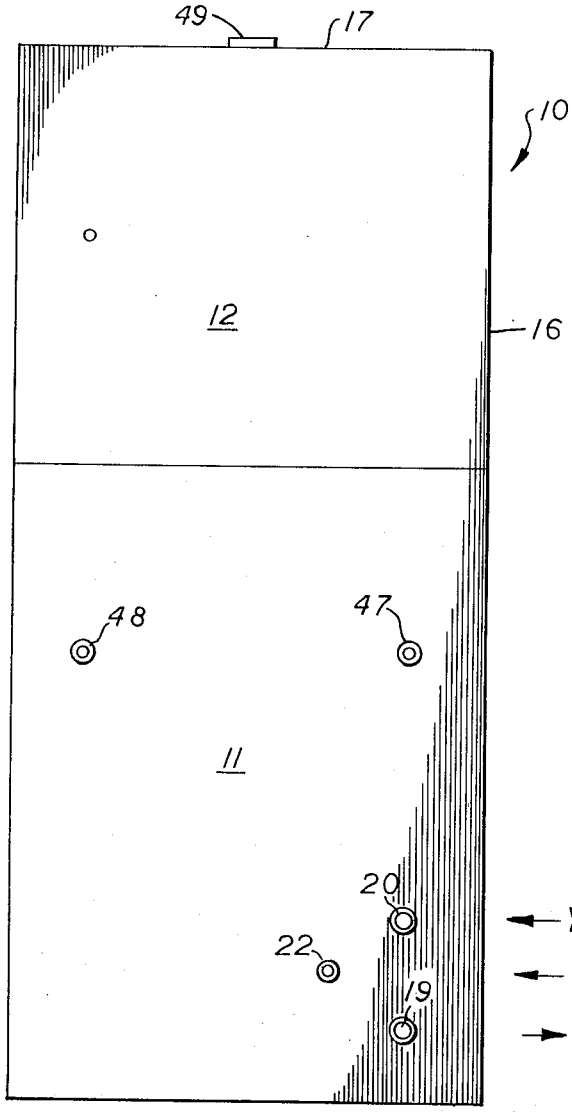
FIG. 2 is a side elevation view of the heater apparatus of FIG. 1.
Figure 4:
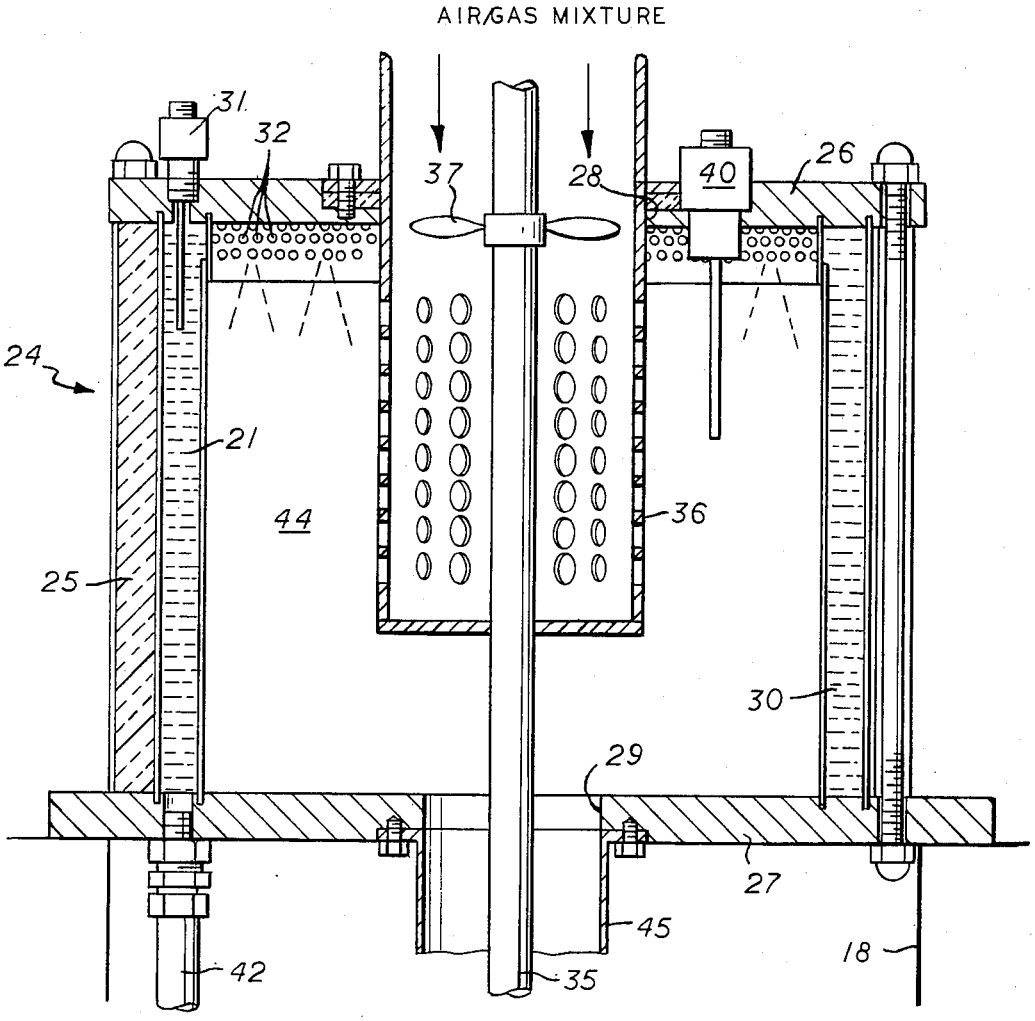
FIG. 4 is a longitudinal cross section taken along line 4—4 of FIG. 1 showing details of the burner and mixer portions of the heater apparatus.
Figure 6:
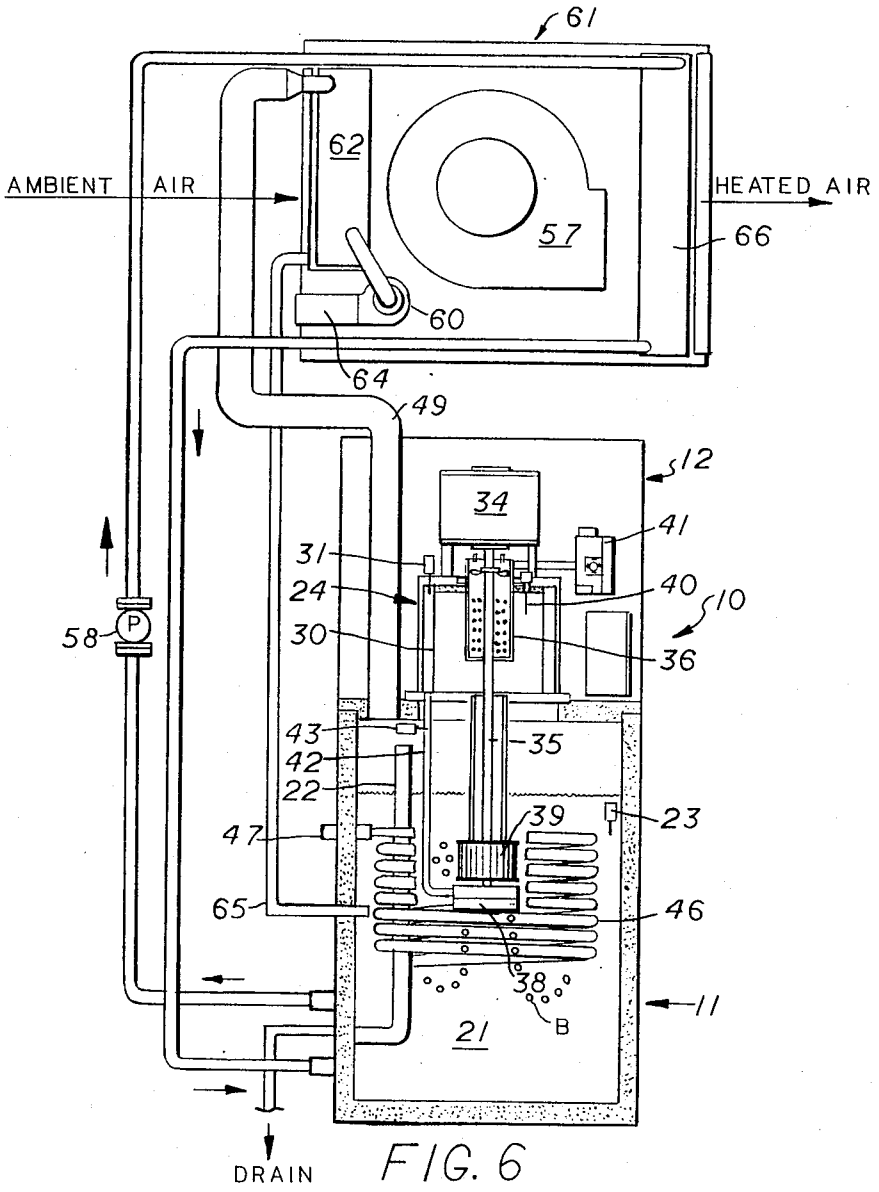
FIG. 6 is a schematic illustration of the heater apparatus in combination with a fan coil unit for providing warm air for house heating and hot water for domestic use.

Referring now to FIGS. 1, 5 and 6, the sequence of operation will be described. FIG. 6 illustrates schematically the application in a system to provide warm air for house heating using fan coil unit 61 along with hot water for domestic use, such as for shower, dishwasher, laundry, etc. The hot water for domestic use is provided by means of coil 46 which is submerged in reservoir liquid 21. Inlet 47 to the coil 46 is connected to the city water line. As the cold water from the city line flows through the coil, it is heated by the surrounding hot liquid in the tank.

The exhaust gases from the reservoir which are typically at 150° F. (reservoir temperature) are drawn through secondary heat exchanger 62 by exhaust blower 60 connected to a PVC vent 64. Air for house heating is pre-heated as it flows across the coil fins of heat exchanger 62. Secondary heat exchanger 62 has a PVC condensate tube 65 to return the condensed water vapor which the hot combustion gases carry from heater reservoir 11. Circulator pump 58 circulates hot water from the reservoir tank through finned coil 66. Blower 57 in unit 61 draws the pre-heated air from the secondary heat exchanger 62 and blows it across the fins of the coil 66. The pre-heated air gets heated further due to the hot water flowing through the coils; thus, warm air is supplied back to the house.

When on-off switch 53 to heater 10 is turned on, temperature control switch 23 detects the water temperature in the reservoir. If reservoir temperature is low, switch 23 turns on suction motor 34 and exhaust blower motor 60 through relay 59. When suction motor 34 is turned on, the water flow to water jacket 30 surrounding burner 36 is sensed by pressure switch 43 which sends a signal to the ignition control unit 62 to turn on the burner 36.

Ignition control unit 33 controls the operation of gas valve 41 and igniter 40 to ignite the gas/air mixture. The ignition control unit 33 is provided with various safety features which will turn off gas valve 41 when required. In the event that the gas fails to ignite after an ignition trial, it will turn off the gas valve 41 and the heater will have to be reset manually.

The hot gases in combustion chamber 24 are cooled by the water spray in the burner assembly. The combustion gases, which are drawn into the reservoir are dispersed in the form of small bubbles B which transfer heat to the water in the tank. Thus, the water in the reservoir gets heated.

When the temperature of the water in the reservoir rises above the upper limit set by temperature control switch 23, the switch turns off gas valve 41, suction motor 34, and exhaust blower motor 60. If for any reason pump 38 in the reservoir, used to cool the gases, does not deliver the required amount of water, the burner is prevented from reaching high temperature by means of temperature controller 31 in water jacket 30 which senses a preset top limit temperature and shuts the burner off.

When used for house heating, room thermostat 55 is turned on and when the temperature in the house is below the set value on the thermostat, the thermostat turns on blower motor 57 and circulator pump motor 58 with the help of relay 56. Blower 57 blows air across hot water coils 66 and thus supplies warm air for house heating. When the house temperature reaches the set value, thermostat 55 turns blower 57 and circulator pump 58 off through relay 56.

The effluent combustion gases are at 85°-90° F. after rejecting heat to the air for house heating. This corresponds to a loss of only 2% in the flue. The water vapor in the flue gases condenses in secondary heat exchanger 62 and the condensate is returned to reservoir 11 through condensate tube 65. Liquid level control tube 22 drains excess water above a predetermined level caused by condensation of the products of combustion in the tank.

One advantage of using the submerged combustion heater in this application is that the sulfur in the natural gas forms sulfuric acid, which condenses in the hot water tank. This system eliminates the need for use of stainless steel or ceramic coated secondary heat exchangers generally used in conventional furnaces to avoid the corrosive effects of the condensate. The heater is capable of space heating and domestic hot water heating in a single unit with efficiencies of 97% or better whereas conventional high efficiency furnaces heat only air.

Figure 7:
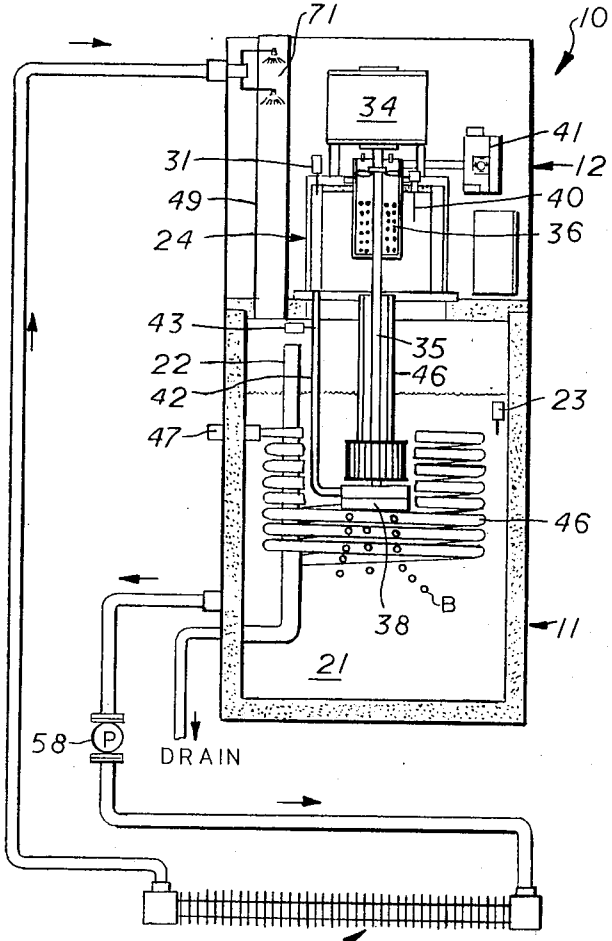
FIG. 7 is a schematic illustration of the heater apparatus in combination with a baseboard-radiator coil unit to supply warm air for house heating and hot water for domestic use.

FIG. 7 illustrates schematically an application of heater 10 in a system to provide warm air for house heating using baseboard radiator coil unit 70 and also providing hot water for domestic use. The hot water for domestic use is provided in the manner described previously and will not be repeated here and previously described components are given the same numerals of reference to avoid repetition.

Circulator pump 58 circulates hot water from the reservoir through baseboard or radiator coil 70 to heat the air in the house. The return water from the baseboard/radiator coil unit 70 is cooler than the water the reservoir 11. The cooler water is sprayed into vent tube 49 through nozzles 71 and returned to the reservoir. Spray nozzles 71 disperse the water in the form of fine droplets which effectively absorb heat from the exhaust gases. In laboratory tests, it has been established that the exhaust gas temperature approaches that of the return water thereby indicating complete heat transfer between the return water and the exhaust gases. Depending on the return water temperature, the efficiency of this unit may vary from 87 to 95 percent.

Figure 8:
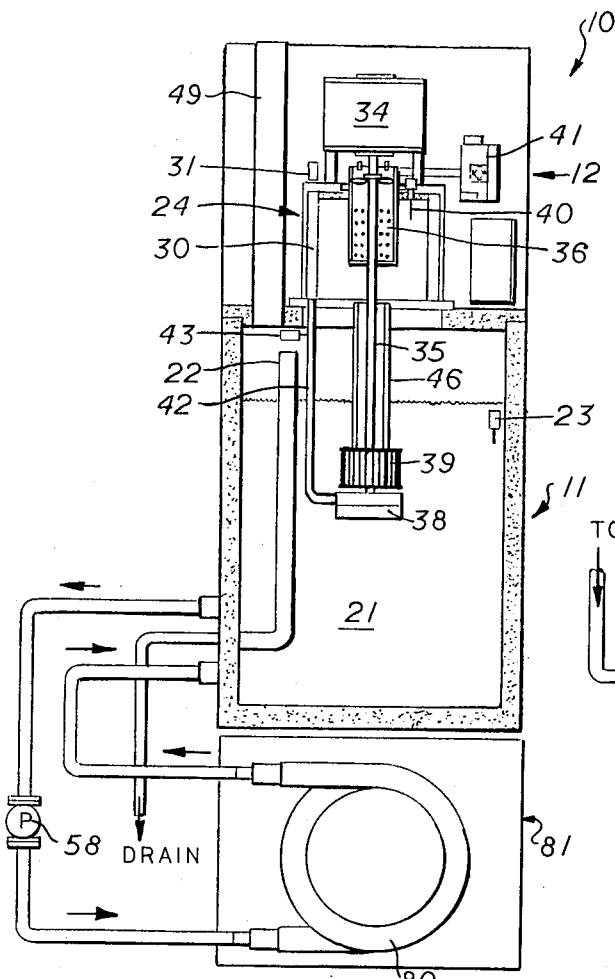
FIG. 8 is a schematic illustration of the heater apparatus in combination with a heat pump evaporator.

As shown in FIG. 8, heater 10 can also be very effectively used for heat pump applications where warm water (85°-90° F.) is supplied in heat exchange with an evaporator coil 80 in the heat pump 81. A circulator pump 58 circulates warm water from reservoir 11 past evaporator coil 80 in heat pump 81. The cool water from heat exchange with the evaporator coil is returned to reservoir 11. The previously described liquid level control tube 22 prevents accumulation of water and products of combustion which condense in the reservoir. In this particular application, the hot water coils 46 are eliminated. Depending on the temperature of the water supplied to exchange heat with evaporator coil 80, and hence the reservoir and exhaust gas temperature, the efficiency of this system is calculated to be very high and may range from 97-98.5%.

Figure 9:
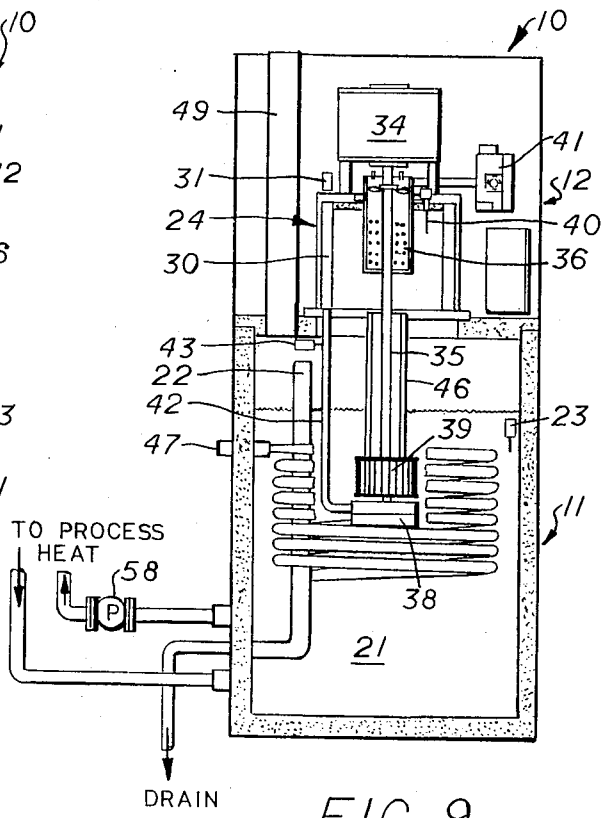
FIG. 9 is a schematic illustration of the heater apparatus use to supply hot water for industrial applications.

As shown in FIG. 9, this heater, using submerged combustion products, may also be installed in various heating systems to supply hot water needed to heat various fluids and chemicals. The efficiency of this application depends on the temperature of the hot water required to heat the process fluids. For tank temperatures of 140°-170° F., the efficiency of this unit may range from 80-87%.

Assuming 10% excess air for combustion at 70° F., and 20% relative humidity, and with temperature of the flue gas ranging from 70° to 150° F. the percentage of heat loss up the stack has been calculated to range from 0.85 at 70° to 16.30 at 150°.

The heater in accordance with the present invention may use various liquid or solid fuels for combustion. Various chemicals may be added to the reservoir liquid to reduce or neutralize the acidity level. Anodes of various materials having a high corrosion rate, such as magnesium may also be placed in the reservoir to prevent excessive corrosion of other system components, and to neutralize the acidity.

While this invention has been described fully and completely with special emphasis upon several preferred embodiments, it should be understood that within the scope of the appended claims the invention may be practiced otherwise than as specifically described herein.

What is claimed is:

1. A method of heating which comprises;

providing a burner and a liquid-containing reservoir, a cylindrical insulated combustion chamber above said reservoir and surrounding said burner, a cylindrical double walled water jacket concentric within said combustion chamber, the upper portion of the inner wall of said jacket having circumferentially spaced apertures therethrough, igniting and burning a mixture of air and fuel in said burner, providing means for creating a suction within said liquid to draw a mixture of air and fuel through said burner and hot combustion gases into said liquid at a rate sufficient to disperse said gases therein in the form of hot gas bubbles transferring heat efficiently to said liqud, comprising an electric motor mounted above said burner and having a rotatable shaft extending downward into said liquid in said reservoir, and a squirrel cage impeller mounted on the lower end of said shaft and submerged in said liquid, whereby rotation of said submerged impeller produces suction for drawing combustion gases into said liquid, establishing a suction within the liquid in said reservoir, by operating said squirrel cage impeller, sufficient to draw a mixture of air and fuel through said burner, ejecting the combustion products into said liquid at a rate sufficient to disperse the same therein in the form of hot gas bubbles to release heat more efficiently to said liquid, and further providing a pump member operatively secured on said shaft submerged in the liquid in said reservoir and connected to said water jacket by a conduit, and operating said pump member for conducting a portion of said liquid through said jacket apertures as a spray into said combustion chamber to cool the combustion gases.

2. A method of heating according to claim 1 including the step of conducting hot liquid from said reservoir through a hot water supply piping system for remote usage.

3. A method of heating according to claim 1 including the steps of removing condensable vapors from a space above said liquid, and controlling the height of the liquid in said reservoir to prevent accumulation of liquid and condensed combustion products above a predetermined level.

4. A method of heating according to claim 3 including the steps of conducting condensable vapors from above the liquid in said reservoir through a heat exchanger coil, and conducting ambient air across said heat exchanger coil to heat the same.

5. A method of heating according to claim 4 including the step of conducting a portion of the hot liquid from said reservoir through a heat exchange coil in the path of the heated ambient air to heat the same further.

6. A method of heating according to claim 3 including the step of conducting a portion of the hot liquid from said reservoir to a radiator for radiant heating of a space.

7. A method of heating according to claim 6 including the step of conducting liquid returning from said radiator into said reservoir through the condensable vapors being removed from the space above the liquid in said reservoir to absorb heat from the condensable vapors.

8. A method of heating according to claim 3 including the step of conducting hot water from said reservoir in heat exchange with the evaporator coil of a heat pump and back into said reservoir.

9. A method of heating according to claim 3 including the step of passing a second liquid through a conduit in heat exchange relation with hot liquid in said reservoir for heating.

10. A method of heating according to claim 9 including the step of conducting said second liquid after heating through a hot water supply piping system for residential or industrial use thereof.

11. A method of heating according to claim 9 including the steps of conducting condensable vapors from the space above the liquid in said reservoir through a heat exchanger, and conducting ambient air across said heat exchanger for heating.

12. A method of heating according to claim 11 including the step of conducting a portion of the hot liquid from said reservoir through a heat exchanger in the path of said heated ambient to heat said air further before being discharged to the space being heated.

13. A method of heating according to claim 9 including the step of conducting a portion of the heated liquid from said reservoir through a radiator for radiant heating of a space being heated.

14. A method of heating according to claim 13 including the step of conducting liquid from said radiator back into said reservoir in heat exchange with the condensable vapors being removed from the space above the liquid in said reservoir to absorb heat therefrom.

15. A method of heating according to claim 9 including the step of conducting hot water from said reservoir in heat exchange with the evaporator coil of a heat pump and back into said reservoir.

16. An apparatus for heating a liquid by circulating combustion products therethrough comprising;

a housing having an insulated reservoir compartment and burner compartment thereabove and air intake means, a liquid in said reservoir compartment, a gas burner including means for igniting and burning a mixture of air and fuel therein, a cylindrical insulated combustion chamber above said reservoir and surrounding said burner, a cylindrical double walled water jacket concentric within said combustion chamber, the upper portion of the inner wall of said jacket having circumferentially spaced apertures therethrough, means for creating a suction within said liquid to draw a mixture of air and fuel through said burner and hot combustion gases into said liquid at a rate sufficient to disperse said gases therein in the form of hot gas bubbles transferring heat efficiently to said liquid, a pump member separate from said suction means operatively secured on a shaft submerged in said liquid and connected to said water jacket by conduit for conducting a portion of said liquid through said jacket apertures as a spray into said combustion chamber to cool the combustion gases.

17. An apparatus according to claim 16 including means for removing the condensable vapors from a space above said liquid, and means for controlling the height of said liquid in said reservoir to prevent accumulation of liquid and condensed products of combustion above a predetermined level.

18. An apparatus according to claim 16 including means for removing condensable vapors from a space above said liquid, means for controlling the height of said liquid in said reservoir to prevent accumulation of liquid and condensed products of combustion above a predetermined level, means connected to a source of fuel and to said burner to provide a mixture of air and fuel to said burner, means for recycling a portion of said liquid in a closed heat exchange system externally of said reservoir, means for conducting a portion of the hot liquid from said reservoir and discharging it in close proximity to said burner to cool the burning mixture of air and gases.

19. An apparatus according to claim 18 in which said means for recycling a portion of said liquid includes a hot water supply piping system for usage of said liquid after heating.

20. An apparatus according to claim 18 including a heat exchanger external of said housing connected with said means for removing condensable vapors from the space above said liquid, means for drawing the condensable vapors removed from the space above said liquid through said heat exchanger, and means for conducting ambient air across said heat exchanger whereby for heating and discharge into a space to be heated.

21. An apparatus according to claim 20 including a second heat exchanger connected with said means for recycling said liquid and positioned in the path of the heated ambient air before discharge into the room, and means for conducting a portion of said hot liquid through said second heat exchanger to heat the ambient air further before discharge into the room.

22. An apparatus according to claim 18 including a radiator external of said housing and connected to said means for recycling said liquid, and means for conducting a portion of said hot liquid through said radiator to provide radiant heating of a space.

23. An apparatus according to claim 22 including means connected with said radiator and said means for removing condensable vapors to conduct said liquid from said radiator back into said reservoir through said condensable vapors in heat exchange therewith.

24. An apparatus according to claim 18 including a heat pump having an evaporator, and means for conducting said first liquid in heat exchange with said evaporator and back into said reservoir.

25. An apparatus according to claim 18 including conduit means for conducting a second liquid in heat exchange with the hot liquid in said reservoir to heat said second body of liquid for external use.

26. An apparatus according to claim 25 in which said conduit means is connected to a hot water system.

27. An apparatus according to claim 25 including a heat exchanger external of said housing connected with said means for removing condensable vapors from a space above the liquid in said reservoir, means for drawing the condensable vapors so removed through said last named heat exchanger, and means for conducting ambient air across said heat exchanger coil for heating.

28. An apparatus according to claim 27 including a second heat exchanger connected with said means for recycling said liquid and positioned in the path of heated ambient air for heat exchange therewith, and means for conducting a portion of said hot liquid through said second heat exchanger for further heating said ambient air.

29. An apparatus according to claim 25 including;

a radiator external of said housing and connected to said means for recycling said liquid, and means for conducting a portion of said hot liquid through said radiator.

30. An apparatus according to claim 29 including means connected with said radiator and said means for removing condensable vapors for conducting said liquid from said radiator back into said reservoir through said condensable vapors for heat exchange therewith.

31. An apparatus according to claim 25 including a heat pump having an evaporator coil including a conduit in heat exchange with the evaporator, and means for conducting said hot liquid through said conduit in heat exchange with said evaporator and back into said reservoir.

32. An apparatus according to claim 18 in which said means for removing the condensable vapors from a space above said first liquid comprises a vent tube having one end communicating with said space and another end extending outward from the burner compartment for escape of hot air and gases from said reservoir.

33. An apparatus according to claim 25 in which said conduit means passing a second liquid through said reservoir comprises;

a tubular coil within said reservoir submerged in said first liquid for connection to a piping system external of said housing.

34. An apparatus according to claim 33 in which said piping system connects said submerged coil into a water supply line of the building being served by the heater to provide hot water for the building.

35. An apparatus according to claim 18 in which said means for removing the condensable vapors from a space above said first liquid comprises a vent tube having one end communicating with said space and another end extending outward from the burner compartment for escape of hot air and gases from said reservoir.

36. An apparatus according to claim 35 including;

a heat exchanger coil external to said housing with an inlet connected to said outwardly extending vent tube end, an exhaust blower connected to the outlet of said heat exchanger coil for drawing the condensable vapors removed from the space above said first liquid therethrough, and a fan adjacent said heat exchanger coil for conducting ambient air across said heat exchanger coil for heating.

37. An apparatus according to claim 36 including a thermostat controlling the operation of said burner, said motor and said blower in response to the temperature of liquid in said reservoir.

38. An apparatus according to claim 36 including a second heat exchanger in the path of the heated ambient air having an inlet and outlet connected to said reservoir by piping, and a pump connected between said reservoir and the inlet of said second heat exchanger to conduct a portion of said hot liquid through said second heat exchanger for further heating of said ambient air.

39. An apparatus according to claim 38 including a thermostat controlling the operation of said fan and pump.

40. An apparatus according to claim 35 including a radiator having an inlet connected to said reservoir by piping and an outlet connected to the extended end of said vent tube, and a pump between the radiator inlet and the reservoir conducting a portion of the hot liquid through the radiator for radiant heating the space being heated.

41. An apparatus according to claim 40 including at least one nozzle installed at the connection of said piping with said vent tube for spraying liquid returning from said radiator into said reservoir through said condensable vapors to absorb heat therefrom.

42. An apparatus according to claim 24 in which said evaporator heat exchanger is connected to said reservoir by piping, and said means for conducting hot liquid through the evaporator heat exchanger and back into said reservoir comprises a pump positioned between the evaporator heat exchanger outlet and said reservoir.

43. An apparatus for heating a liquid by circulating combustion products therethrough comprising;

a housing having an insulated reservoir compartment and burner compartment thereabove and air intake means, a liquid in said reservoir compartment, a gas burner including means for igniting and burning a mixture of air and fuel therein, means for creating a suction within said liquid to draw a mixture of air and fuel through said burner and hot combustion gases into said liquid at a rate sufficient to disperse said gases therein in the form of hot gas bubbles transferring heat efficiently to said liquid, comprising an electric motor mounted above said burner and having a rotatable shaft extending downward into said liquid in said reservoir, and a squirrel cage impeller mounted on the lower end of said shaft and submerged in said liquid, whereby rotation of said submerged impeller produces suction for drawing combustion gases into said liquid, means for removing condensable vapors from a space above said liquid, means for controlling the height of said liquid in said reservoir to prevent accumulation of liquid and condensed products of combustion above a predetermined level, means connected to a source of fuel and to said burner to provide a mixture of air and fuel to said burner, means for recycling a portion of said liquid in a closed heat exchange system externally of said reservoir, means for conducting a portion of the hot liquid from said reservoir and discharging it in close proximity to said burner to cool the burning mixture of air and gases, comprising a cylindrical insulated combustion chamber above said reservoir and surrounding said burner, a cylindrical double walled water jacket concentric within said combustion chamber, the upper portion of the inner wall of said jacket having circumferentially spaced apertures therethrough, a pump member operatively secured on said shaft submerged in said liquid and connected to said water jacket by conduit for conducting a portion of said liquid through said jacket apertures as a spray into said combustion chamber to cool the combustion gases.

44. An apparatus according to claim 43 including a temperature control switch having a sensor element extended into said water jacket which will turn said burner off upon a rise in temperature of said first liquid being used to cool the combustion gases above a predetermined limit.

45. An apparatus according to claim 43 including a pressure responsive switch positioned in the conduit between said pump and said water jacket to control the ignition of said burner and operation of said gas valve.

46. An apparatus for heating a liquid by circulating combustion products therethrough comprising;

a housing having an insulated reservoir compartment and burner compartment thereabove and air intake means, a liquid in said reservoir compartment, a gas burner including means for igniting and burning a mixture of air and fuel therein, means for creating a suction within said liquid to draw a mixture of air and fuel through said burner and hot combustion gases into said liquid at a rate sufficient to disperse said gases therein in the form of hot gas bubbles transferring heat efficiently to said liquid, comprising an electric motor mounted above said burner and having a rotatable shaft extending downward into said liquid in said reservoir, and a squirrel cage impeller mounted on the lower end of said shaft and submerged in said liquid, whereby rotation of said submerged impeller produces suction for drawing combustion gases into said liquid.

means for removing condensable vapors from a space above said liquid, means for controlling the height of said liquid in said reservoir to prevent accumulation of liquid and condensed products of combustion above a predetermined level, means connected to a source of fuel and to said burner to provide a mixture of air and fuel to said burner, means for recycling a portion of said liquid in a closed heat exchange system externally of said reservoir, means for conducting a portion of the hot liquid from said reservoir and discharging it in close proximity to said burner to cool the burning mixture of air and gases, further including a plurality of radially extending blades on the upper portion of said shaft for rotation therewith to induct the mixture of air and fuel from said valve means into said burner and premix the air and fuel for combustion.

* * * * *